US008191270B2

(12) United States Patent
Steinman

(10) Patent No.: US 8,191,270 B2
(45) Date of Patent: Jun. 5, 2012

(54) BOW SIGHT

(76) Inventor: Roger A. Steinman, Auburn, IN (US)

( * ) Notice: Subject to any disclaimer, the term of this patent is extended or adjusted under 35 U.S.C. 154(b) by 218 days.

(21) Appl. No.: 12/788,664

(22) Filed: May 27, 2010

(65) Prior Publication Data

US 2011/0035951 A1 Feb. 17, 2011

Related U.S. Application Data

(60) Provisional application No. 61/233,206, filed on Aug. 12, 2009.

(51) Int. Cl.
*F41G 1/467* (2006.01)

(52) U.S. Cl. ..... 33/265; 124/87

(58) Field of Classification Search ..... 33/265, 33/297, 298; 124/87
See application file for complete search history.

(56) References Cited

U.S. PATENT DOCUMENTS

| | | | | |
|---|---|---|---|---|
| 4,638,565 | A * | 1/1987 | Podany et al. | 33/265 |
| 4,720,919 | A * | 1/1988 | Saunders | 33/265 |
| 5,305,530 | A * | 4/1994 | Robertson et al. | 33/265 |
| 5,465,491 | A * | 11/1995 | Thell | 33/265 |
| 5,579,752 | A * | 12/1996 | Nelson et al. | 124/87 |
| 6,061,919 | A * | 5/2000 | Reichert | 33/265 |
| 7,100,319 | B2 * | 9/2006 | Paige | 33/298 |
| 7,222,432 | B2 * | 5/2007 | Pai et al. | 33/297 |
| 7,461,460 | B2 * | 12/2008 | Priebe | 33/265 |
| 2003/0136012 | A1 * | 7/2003 | Walbrink | 33/265 |
| 2011/0214304 | A1 * | 9/2011 | Priebe | 33/265 |
| 2011/0296699 | A1 * | 12/2011 | Mainsonneuve et al. | 33/265 |

* cited by examiner

*Primary Examiner* — G. Bradley Bennett
(74) *Attorney, Agent, or Firm* — Taylor IP, P.C.

(57) ABSTRACT

An optical sighting system for use with a targeting device. The optical sighting system includes a structural member, a first sighting member, and a second sighting member. The first sighting member is connected to the structural member. The second sighting member is configured for optical alignment with the first sighting member to thereby orient the targeting device. The second sighting member has a weighted element that orients the second sighting member substantially independently of the structural member.

20 Claims, 3 Drawing Sheets

BOW SIGHT

This is a non-provisional application based upon U.S. provisional patent application Ser. No. 61/233,206, entitled "Bow Sight", filed on Aug. 12, 2009, which is incorporated herein by reference.

BACKGROUND OF THE INVENTION

1. Field of the Invention

The present invention relates to a bow mounted sight, and, more particularly, to bow mounted sight that assists the hunter in orienting the bow for more accurate shooting.

2. Description of the Related Art

Hunters have used archery equipment, and, more particularly, a bow and arrow for thousands of years. Hunters are required to take into account the distance to the target, the effect of crosswinds, the mass of the arrow, and the velocity at which the arrow is being fired to accurately hit the target. Often, the hunter must make estimates for these factors and adjust their aim accordingly.

To assist the archer in hitting the intended target, bow mounted sights have been developed for assisting in the targeting of the game or target. One method utilized is a series of sighting pins mounted on the bow for aiming the arrow at the target, with the archer selecting the pin to account for the distance to the target. The archer can sight-in the bow for the specific distance to the target by adjusting the pins of the sight and firing the arrow at a target to verify that the arrow hits the intended target at that distance for that particular sighting pin.

The targeting methods typically require the alignment of two points. For example, an archer can utilize the same anchor point, such as a selected point on the archer's cheek, and the archer's eye and one sight point is used to keep the arrow on target. However, it is sometimes difficult to get exactly the same anchor point and a common solution to this is to mount a peep sight on the bow string. A peep sight is generally a small device with a hole in the center of it and the strands of the bow string are separated with the peep sight being inserted therebetween. The archer looks through the peep sight and aligns the selected pin on the target for sighting purposes.

What is needed in the art is a sighting system that helps the archer align the bow and is quick to be brought on target.

SUMMARY OF THE INVENTION

The present invention is related to an optical sighting system for use with a targeting device, such as a bow.

The invention in one form is an optical sighting system for use with a targeting device. The optical sighting system includes a structural member, a first sighting member, and a second sighting member. The first sighting member is connected to the structural member. The second sighting member is configured for optical alignment with the first sighting member to thereby orient the targeting device. The second sighting member has a weighted element that orients the second sighting member substantially independently of the structural member.

BRIEF DESCRIPTION OF THE DRAWINGS

The above-mentioned and other features and advantages of this invention, and the manner of attaining them, will become more apparent and the invention will be better understood by reference to the following description of embodiment of the invention taken in conjunction with the accompanying drawings, wherein.

Corresponding reference characters indicate corresponding parts throughout the several views. The exemplification set out herein illustrates one embodiment of the invention and such exemplification is not to be construed as limiting the scope of the invention in any manner.

DETAILED DESCRIPTION OF THE INVENTION

Figure 1:
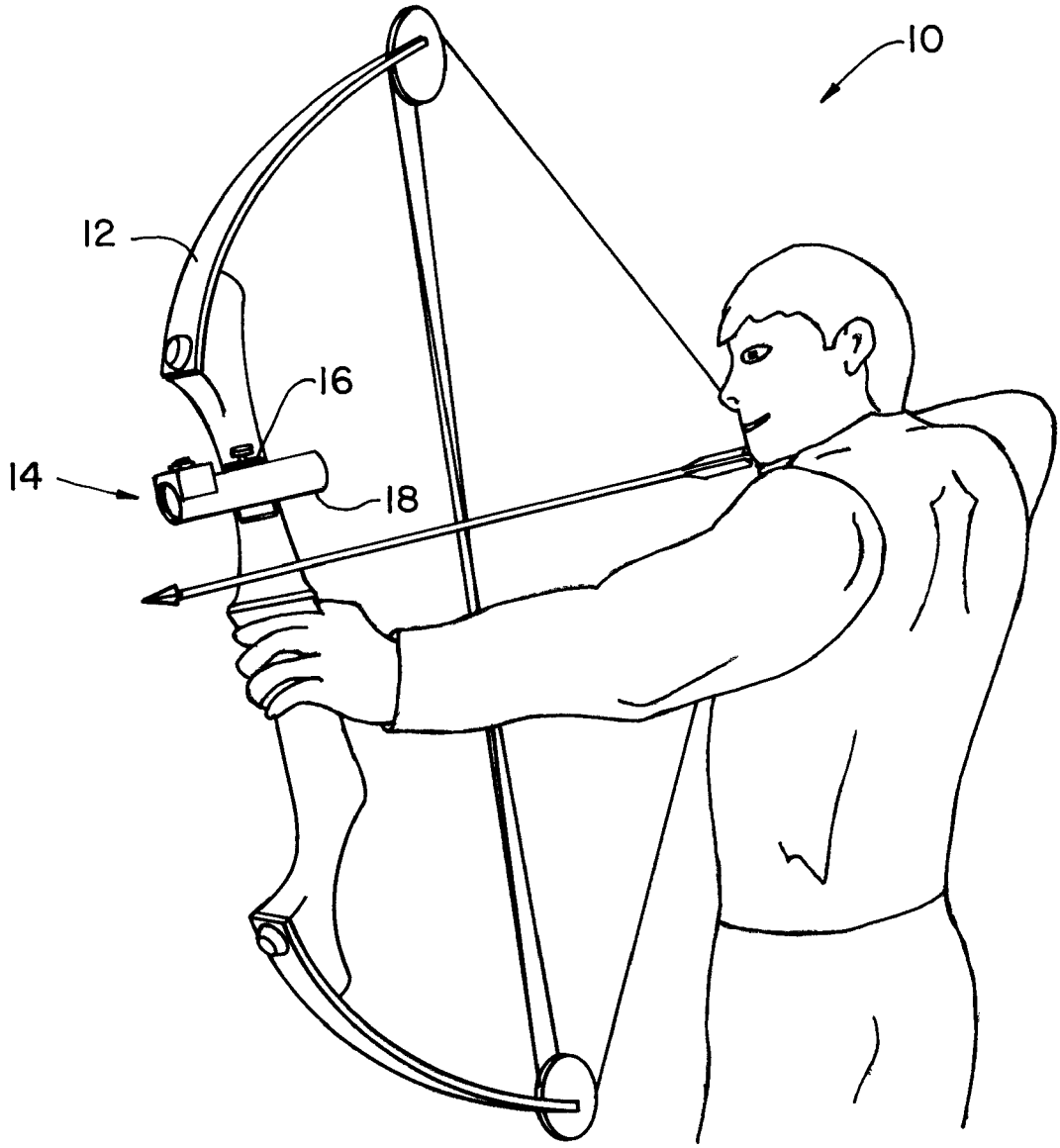
FIG. 1 illustrates an archer utilizing a bow with an embodiment of a bow sighting system of the present invention.
Figure 2:
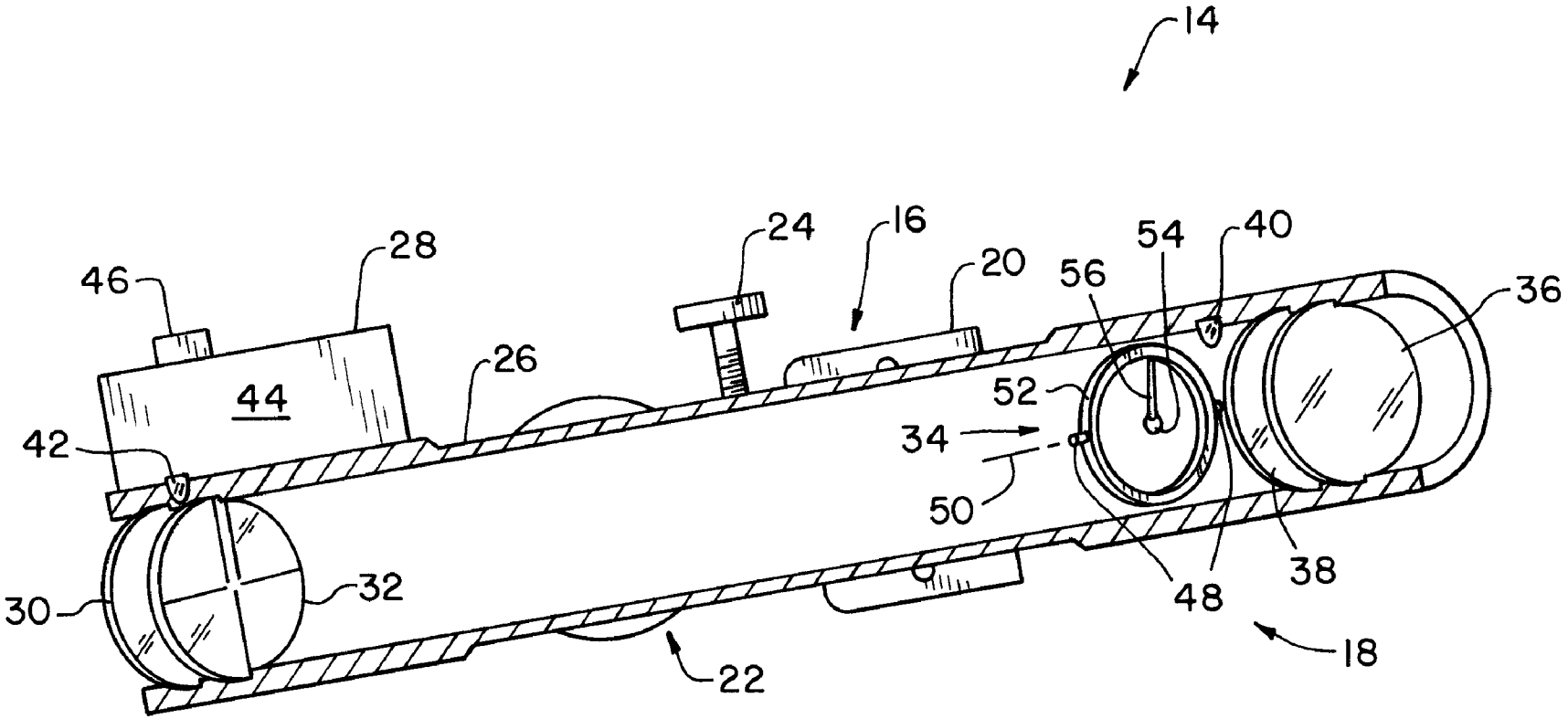
FIG. 2 is a perspective, partial cross-section of the bow sight of FIG. 1.
Figure 3:
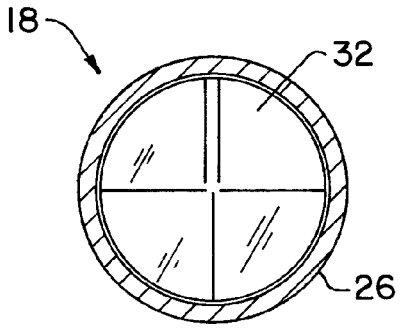
FIG. 3 is a partial cross-section across the tube of the optical system illustrating a reticle of the present invention.

Referring now to the drawings, and more particularly to FIG. 1, there is shown a targeting system 10 that includes a bow 12 having a bow sight system 14. Bow sight system 14 includes a mounting system 16 and an optical sight 18. Optical sight 18 is connected to bow 12 by way of mounting system 16. Mounting system 16 allows for the pivoting of sight 18 relative to bow 12. Bow 12 is utilized by an archer with bow sighting system 14 being used to align the bow vertically as well as on target for accurate release of the arrow.

Now, additionally referring to FIGS. 2-6, there is shown bow sighting system 14 and, more particularly, sight 18 with mounting system 16 attached thereto. Mounting system 16 includes attachment device 20, pivoting connection 22, and range adjustment 24. Attachment device 20 may have holes therein so that it can be attached to bow 12 by way of threaded fasteners or other connective devices. Pivoting connection 22 allows for sight 18 to be pivoted relative to bow 12. Range adjustment 24 may be in the form of a knob that is utilized to turn a threaded portion so that sight 18 is pivoted about pivoting connection 22.

Sight 18 includes a tube 26, a lighting system 28, optical glass 30, reticle 32, a pivoting assembly 34, an optical glass 36, and a lens 38. Tube 26 may be an optical tube such as one used for rifle hunting scopes or the like and may have further optics therein to provide for magnification. Tube 26 may be hermetically sealed and contain a gas that reduces the likelihood of moisture condensation therein. Optical glass 30 may be provided to protect reticle 32 and optical glass 30 may have some optical focusing and/or magnification properties. Reticle 32 is further illustrated in FIG. 3 as having one embodiment of a pattern. The pattern has two upper vertical lines and a gap at the center, where the horizontal lines and the lower vertical line would have met. The positioning of these lines is one representation of the lines that can be used for the alignment of optical sight 18. The present invention uses reticle 32 in coordination with parts of pivoting assembly 34 to assist the archer in the alignment of bow 12. Optical glass 36 and lens 38 provide transmission of the light therethrough so that the archer can see pivoting assembly 34 and its alignment relative to reticle 32.

Lighting system 28 includes a red light emitting diode (LED) 40, a white LED 42, a power source 44, and a switch 46. Red LED 40 is utilized to provide a spectrum of light for reflection off of a portion of pivoting assembly 34 to help differentiate it from the illumination of reticle 32. Reticle 32 has lines thereon that redirect some of the white light from white LED 42 so that the archer sees the line thereon being white, which is in contrast to the red illumination directed to pivoting assembly 34. Power source 44 may include batteries that are wired by way of switch 46 to provide power to LEDs 40 and 42, providing light within tube 26 so that pivoting assembly 34 can coact with reticle 32 to provide aligning information to the archer. Although it is not illustrated, it is also contemplated that the illumination level can be adjusted for each of LEDs 40 and 42.

Figure 4:
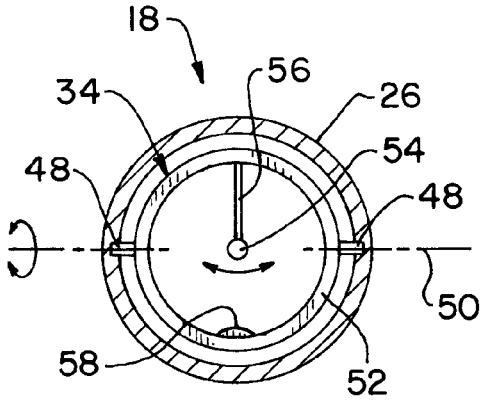
FIG. 4 is a cross-sectional view of the pivoting ring of the sighting system of FIGS. 1-3.
Figure 5:
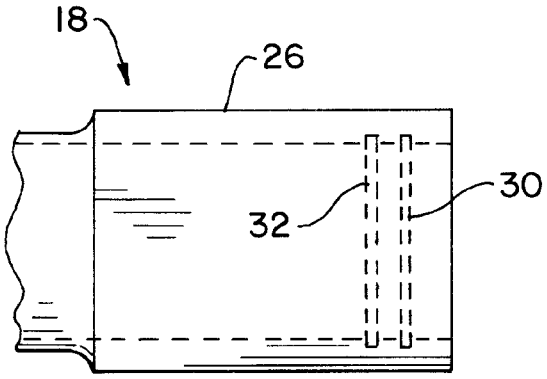
FIG. 5 is a partial side view of one end of the sighting system of FIGS. 1-4.
Figure 6:
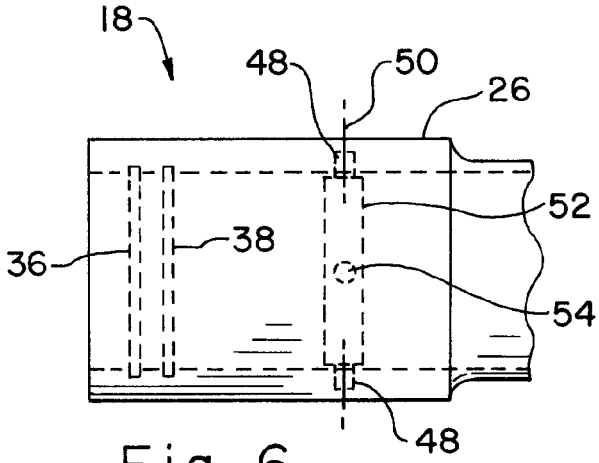
FIG. 6 illustrates another end of the sighting system of FIGS. 1-5.

Pivoting assembly 34 includes pivot points 48 which allow pivoting of pivoting assembly 34 about axis 50. Pivoting assembly 34 further includes a weighted ring 52, a plumb bob 54, a suspension line 56, and a weight 58. Ring 52 has pivot points 48 extending therefrom on opposite sides thereof. Pivoting points 48 interface with tube 18 to provide for the movement of ring 52 about axis 50. While pivot points 48 are described as extending from ring 52, they can, of course, extend from tube 18 and interact with bearing surfaces within ring 52. Weight 58 biases ring 52 so that it aligns with the gravitational field to orient ring 52 so that ring 52 is substantially vertical during use. Plumb bob 54 is a weighted element that is suspected by suspension line 56 from ring 52. Plumb bob 54 can move in at least one plane as illustrated in FIG. 4. When the archer aligns bow 12 utilizing bow sight system 14, the archer sees plumb bob 54, as well as suspension line 56. The archer aligns bow 12 so that suspension line 56 appears between the two upper vertical lines of reticle 32 and plumb bob 54 appears to be positioned in the space provided at the center of reticle 32. This alignment assists the archer in keeping bow 12 in a substantially vertical position, which can also be thought of as a repetitive alignment feature of the present invention. Angular positioning of bow 12, for example, a declination angle from a tree stand where the archer has aligned the arrow to take a downward path, causes ring 52 to pivot about axis 50 so that pendulum-like structure plumb bob 54 remains aligned about axis 50 to keep the sight system accurately aligned by the archer.

Targeting system 10 has been illustrated with bow 12; however, other targeting systems, such as a cross bow or laser, etc. can be utilized where vertical alignment of an axis of the targeting system, as well as compensation for angular positioning, is a desirable feature, such as is provided by the present invention.

While ring 52 has been described herein, other constructs of ring 52 are also contemplated, including non-ring structures or asymmetrical ring structures that preclude the need of adding a weight 58, with the asymmetric nature being such that there is more mass at the bottom of ring 52 than at the top. It is also anticipated that biasing elements, such as springs, can be utilized relative to ring 52. The biasing of ring 52 could be different in one direction of an angular positioning versus another direction of angular positioning. Additionally, suspension line 56 may have some stiffness or damping features so that plumb bob 54 does not oscillate unnecessarily. It is also contemplated that suspension line 56 and plumb bob 54 may be the same or different colors to assist in the alignment of suspension line 56 and plumb bob 54 relative to the lines of reticle 32. The contrasting color and illumination of plumb bob 54 relative to the illumination in reticle 32 add to the intuitive alignment and ease of use of bow sight system 14 for the archer. The present invention advantageously is not only easy to use but also allows for a minimal amount of instruction. It is lightweight and can be used in low light conditions.

During use, as bow 12 is elevated or declinated, ring 52 responds to compensate for the inclination and declination, while plumb bob 54 provides for the proper alignment with reticle 32 for both vertical alignment of bow 12 and targeting alignment. If ring 52 were not present, then elevation or declination would cause plumb bob 54 to deviate from its alignment with axis 50.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An optical sighting system for use with a targeting device, the optical sighting system comprising:
- a structural member;
- a first sighting member connected to said structural member; and
- a second sighting member configured for optical alignment with said first sighting member to thereby orient the targeting device, said second sighting member having a weighted element that orients said second sighting member substantially independently of said structural member.

2. The optical sighting system of claim 1, wherein said first sighting member is a reticle.

3. The optical sighting system of claim 2, wherein said weighted element is a pendulum.

4. The optical sighting system of claim 3, wherein said pendulum has a freedom of movement in at least one plane.

5. The optical sighting system of claim 3, wherein said second sighting member further includes a pivoting member pivotingly connected to said structural member.

6. The optical sighting system of claim 5, wherein said pendulum is connected to said pivoting member.

7. The optical sighting system of claim 6, wherein said pivoting member has a weighted portion.

8. The optical sighting system of claim 7, wherein said pivoting member is a pivoting ring, said pendulum being connected to said pivoting ring at a connection point, said connection point being substantially opposite said weighted portion.

9. The optical sighting system of claim 8, wherein said pivoting member has two pivoting connections to said structural member, said two pivoting connections being on opposite sides of said pivoting ring, said weighted member being substantially equidistant from said two pivoting connections.

10. The optical sighting system of claim 9, wherein said structural member has a tubular form.

11. The optical sighting system of claim 9, further comprising a lighting system providing light to said first sighting member and to said second sighting member.

12. The optical sighting system of claim 11, wherein light provided to said first sighting member is a first color light, said light provided to said second sighting member being a second color light, said first color light being different from said second color light.

13. A targeting system, comprising:
- a projectile issuing mechanism;
- an optical sighting system connected to said projectile issuing mechanism, the optical sighting system including:
  - a structural member;
  - a first sighting member connected to said structural member; and a second sighting member configured for optical alignment with said first sighting member to thereby orient the targeting device, said second sighting member having a weighted element that orients said second sighting member substantially independently of said structural member.

14. The targeting system of claim 13, wherein said first sighting member is a reticle, and said weighted element is a pendulum.

15. The targeting system of claim 14, wherein said second sighting member further includes a pivoting member pivotingly connected to said structural member.

16. The targeting system of claim 15, wherein said pendulum is connected to said pivoting member.

17. The targeting system of claim 16, wherein said pivoting member has a weighted portion.

18. The targeting system of claim 17, wherein said pivoting member is a pivoting ring, said pendulum being connected to said pivoting ring at a connection point, said connection point being substantially opposite said weighted portion.

19. The targeting system of claim 18, wherein said pivoting member has two pivoting connections to said structural member, said two pivoting connections being on opposite sides of said pivoting ring, said weighted member being substantially equidistant from said two pivoting connections.

20. The targeting system of claim 19, further comprising a lighting system providing light to said first sighting member and to said second sighting member, said structural member having a tubular form, light provided to said first sighting member is a first color light, said light provided to said second sighting member being a second color light, said first color light being different from said second color light.

* * * * *